United States Patent [19]

Potter et al.

[11] Patent Number: 4,978,416

[45] Date of Patent: Dec. 18, 1990

[54] STACK FED LABELING MACHINE

[75] Inventors: Terry Potter, Sylvania; Philip J. Breno, Oregon, both of Ohio; Lyn E. Bright, Ceres, Calif.

[73] Assignee: B & H Manufacturing Company, Inc., Ceres, Calif.

[21] Appl. No.: 264,317

[22] Filed: Oct. 28, 1988

[51] Int. Cl.[5] ..... B65C 9/10; B65C 9/14

[52] U.S. Cl. ..... 156/571; 156/DIG. 29; 156/DIG. 31; 271/31; 271/31.1; 271/98; 271/112; 271/126; 271/149; 271/150; 271/276

[58] Field of Search ..... 156/571, 572, 564, 573, 156/DIG. 29, DIG. 31; 271/30.1, 31, 31.1, 126, 98, 112, 94, 12, 129, 130, 276, 149, 150, 151

[56] References Cited

U.S. PATENT DOCUMENTS

| | | | |
|---|---|---|---|
| 2,703,660 | 3/1955 | Von Hofe et al. | 156/571 |
| 3,201,114 | 8/1965 | Swartz et al. | 271/150 |
| 3,240,488 | 3/1966 | Lyman | 271/31.1 |
| 3,572,686 | 3/1971 | Day | 271/94 |
| 3,759,509 | 9/1973 | Peterson | 271/150 |
| 4,293,365 | 10/1981 | Geyser et al. | 156/364 |
| 4,323,230 | 4/1982 | Rising | 271/31.1 |
| 4,565,596 | 1/1986 | Clowe | 156/564 |

*Primary Examiner*—Michael Wityshyn

*Attorney, Agent, or Firm*—Flehr, Hohbach, Test, Albritton & Herbert

[57] ABSTRACT

Labeling machine of the stack fed type in which the labels are precut and arranged vertically in a horizontal stack. Pressure is applied to the rear of the stack to move the stack forwardly as the labels are dispensed to a label transfer mechanism such as a vacuum drum. Air is blown into the stack from the bottom at the forward end of the stack to separate the foremost label, which is picked up from the stack by a rotating vacuum wheel.

2 Claims, 2 Drawing Sheets

STACK FED LABELING MACHINE

This invention relates to a labeling machine of the stack or magazine type in precut labels are arranged in a stack and are extracted from the stack one by one and supplied to a label transport which in turn transports each label to a container transport for application to a container at a label applying station.

It is an object of the present invention to provide a stack or magazine type of labeling machine which is faster and more efficient than heretofore. For example, stack fed labeling machines typically have labels arranged horizontally in a vertical stack from which they are extracted at the bottom of the stack and transferred to a vacuum drum which transports the labels to a container transport for application of labels.

It will be understood that wrappers other than labels may be applied, for example for strengthening a container or for decorative purposes, and that articles other than containers may be wrapped with labels or the like.

The present invention is illustrated by way of example in the accompanying drawings, in which.

Figure 1:
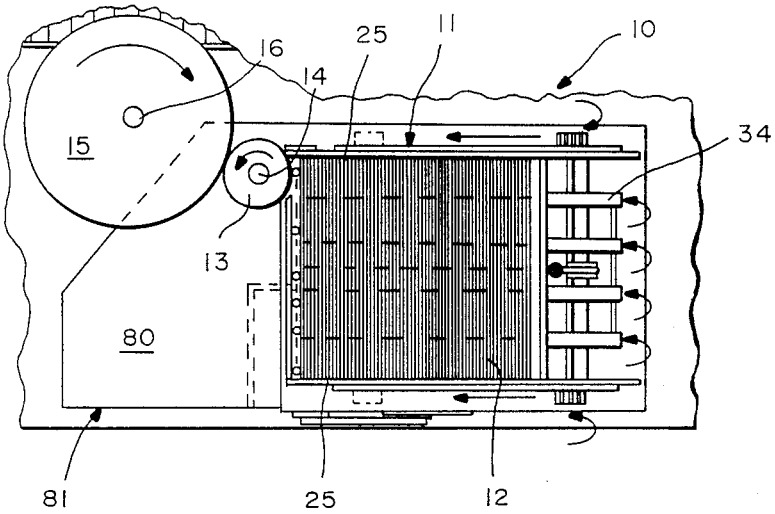
FIG. 1 is a top plan view of a portion of a labeling machine.
Figure 2:
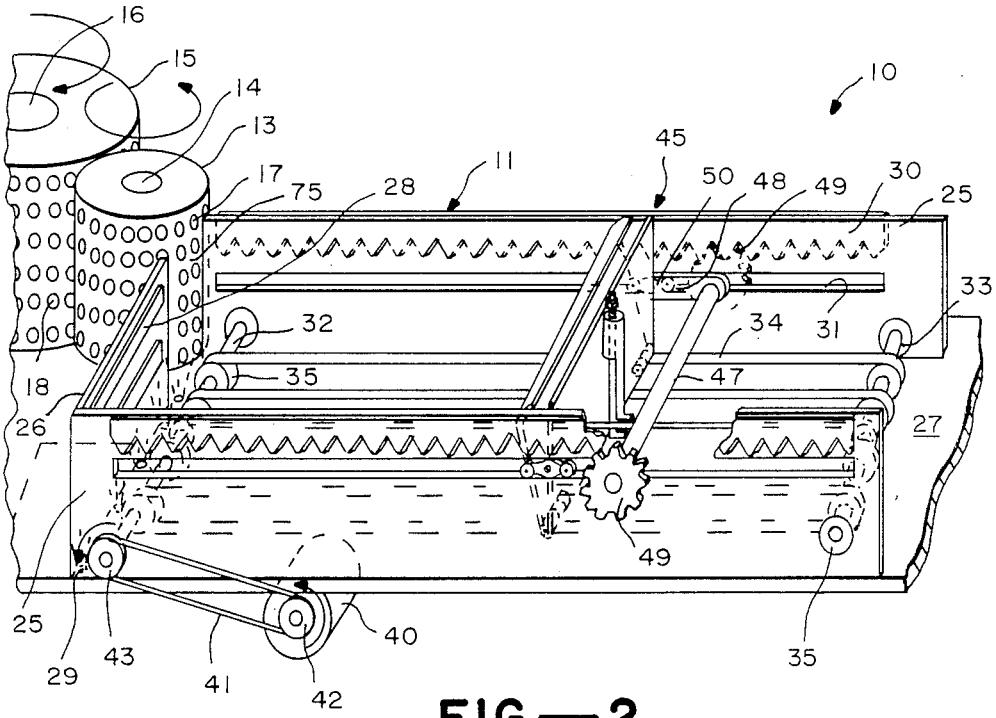
FIG. 2 is a perspective view with parts broken away.

Referring now to FIGS. 1 and 2, a labeling machine is shown which is generally designated by the reference numeral 10 and it comprises a label holder 11 for holding a stack of labels 12 in vertical position, the stack itself being in horizontal position. A vacuum transfer wheel 13 rotating on a shaft 14 picks up each label as it is extracted from the holder and transfers it to a vacuum drum 15 rotating about a shaft 16. The wheel 13 has openings 17 and the vacuum drum 15 has openings 18 through which vacuum is exerted to suck labels onto them and to hold them on the respective parts.

The vacuum drum 15 transports labels to a label applying station where each label is applied to a container, for example by means of glue, and where the label is wrapped around the container. Suitable glue applicators, label wrapping mechanisms, vacuum systems, etc. are well known, being described, for example, in U.S. Pat. Nos. 4,500,386; 4,108,710; 4,704,173; 4,181,555, etc. The labels 12 may be rectangular for application to cylindrical containers by wrapping them partially or completely around the containers or the labels may be of other shapes.

The label holder 11 is formed by spaced, parallel side walls 25, a front wall 26 and a bottom 27. The front wall 26 has smooth plastic strips 28 applied to its innerface to reduce friction so that labels can be extracted more readily. The bottom 27 is formed at its front (lefthand as viewed in FIG. 1) end with holes across its width, one such hole being shown at 29 for the purpose of admitting a current of air for a purpose described below. Affixed to each side wall 25 is a rack 30 below which is a horizontal slot 31. A pair of shafts 32 and 33 are provided, both rotatably mounted in the side walls 25, one at the front end of the holder and the other at the rear end and carrying belts 34. The central belt 34A is round in cross section. Pulleys 35 are mounted on the shafts and belts 34 and 34A engage the pulleys. A motor 40, a belt 41 and pulleys 42 and 43 serve to drive shaft 32 and through belts 34 and 34A the shaft 33, the direction of movement of the upper course of the belts being from right to left as viewed in FIGS. 1 and 2.

For the purpose of maintaining adequate pressure on the labels 12 so as to hold them in upright position and tightly compressed, a compressor mechanism is provided which is generally designated by the reference numeral 45. This mechanism is shown in perspective in FIG. 2 and partially (also in perspective) in FIG. 3.

The compressor mechanism 45 comprises a vertical plate 46 which is mounted on a shaft 47 by means of brackets 48, the shaft 47 having a pinion 49 at each end which engages one or the other of the racks 30. This rack and pinion construction permits the plate 46 to move forwardly and rearwardly but prevents lateral movement; i.e. the plate 46 is held in vertical position parallel to the front wall 26 of the holder 11. Additional support for the plate 46 is provided by rollers 50 mounted on suitable brackets affixed to the plate 46. The rollers 50 ride in the slots 31.

Figure 3:
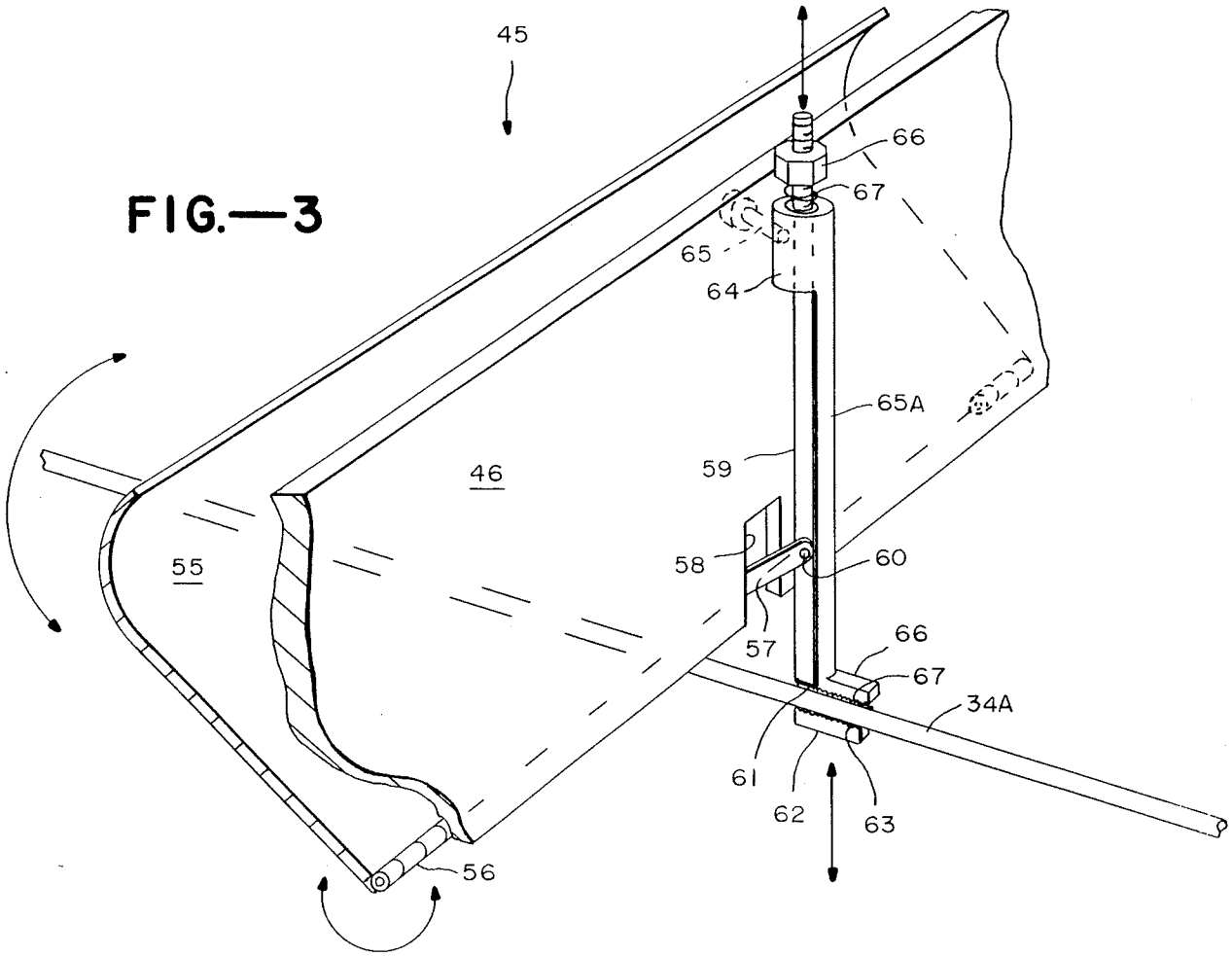
FIG. 3 is a perspective view of the mechanism employed to feed the label forwardingly as they are depleted.

Referring more particularly to FIG. 3, a pressure sensing plate 55 is hinged at 56 to the lower edge of the plate 46 whereby it may pivot between a vertical or near vertical position and a forwardly tilted position. An arm or lever 57 is rigidly connected at one end to the plate 55 and extends through a slot 58 in the plate 46 to a rod 59 to which it is pivotally connected at 60. The rod 59 is slotted at its lower end at 61 to receive belt 34A and it is formed at its lower end with a jaw 62 having a serrated surface 63 adjacent the belt 34A. The upper end of the rod 59 is slidable through a bracket 64 bolted at 65 to the plate 46. The upper end of rod 59 is threaded to receive a nut 66 which may be turned to adjust the compression of a spring 67 which bears against the bracket and tends to thrust the rod 59 upwardly to engage the jaw 62 with the belt 35A.

The bracket 64 has a downward extension 65A terminating in a jaw 66 having a serrated surface 67.

In operation, as the stack of labels 12 is depleted the plate 55 will tilt forwardly on its hinge 56 and, acting through lever 57, will lift jaw 62. The two jaws 67 and 62 will therefore clamp the belt 34A which is moving forwardly. This will cause the plates 46 and 55 to move forwardly with the belt 34A and will move the rod 59 downwardly relaxing the pressure of jaw 62 on the belt 35A, thus halting further forward movement of the plates 46 and 55 and allowing plate 55 to tilt forwardly again. Thus a slip clutch mechanism is provided which serves to maintain adequate pressure on the stack of labels and to keep them in tight compression.

When the stack is emptied or is approaching being emptied a new stack may be inserted. This may be done by application of manual pressure without interrupting the labeling operation.

Meanwhile air is blown through the holes 29 to separate the labels near the front wall 26 of the holder 11 and to facilitate removal of labels individually by the vacuum wheel 13. An opening 75 is provided to permit contact of the leading label in the holder with the vacuum wheel 13 which, by vacuum, sucks each label in turn from the stack and transfers it to the vacuum drum 15.

Operation of the vacuum wheel 13 and the vacuum drum 15 will be accomplished by means well known in the art. For example the suction through holes 17 in vacuum wheel 13 may be terminated as they approach tangent contact with the vacuum drum 15 to release each label to the vacuum drum. The air pressure system of the labeling machine is employed to blow air through the holes 29.

Referring to FIG. 1, it will be seen that the label feed including the label holder 11 and the feed roller 13 are mounted on a plate 80 which, together with the components mounted on it constitute a module which is mounted on the frame of the labeling machine. As described in U.S. patent application Ser. No. 263,177, filed Oct. 27, 1988 by Lyn E. Bright entitled "CONVERTIBLE LABELING MACHINE", now abandoned the module 81 may be removed and replaced by a module which pulls continuous label stock from a roll and continuously cuts the moving strip into individual labels by a cut extending entirely across the strip and applying each label to a vacuum drum such as that shown in FIGS. 1 and 2. The replacement module may instead be one which severs individual labels from a strip leaving scrap material as shown in U.S. Pat. No. 4,181,155 or it may be replaced by a module which peels labels having a pressure sensitive layer from a continuous backing. Likewise any of these modules may be replaced by the module on plate 80.

It will therefore be apparent that a novel and useful stack fed labeling machine has been provided.

We claim:

1. Apparatus for dispensing labels or other sheet material in the form of precut segments, each segment having a flat shape defined by a front face, a rear face, an upper edge, a lower edge and two side edges, said edges being the boundaries of said faces, said segments being arranged adjacent one another in a horizontal stack with their front faces facing forwardly and their rear faces facing rearwardly, said apparatus comprising:

(a) a holder serving to hold such segments in a horizontal stack with their front faces facing forwardly and their rear faces facing rearwardly (b) compressor means for applying pressure to the rear of the stack to cause the segments to move forwardly as the segments are dispensed (c) forwardly moving belt means beneath the compressor means to move the segments forwardly, and slip clutch means connecting the compressor means with said belt means to move the compressor means forwardly as the segments are dispensed said slip clutch means serving automatically to engage the compressor means with and to disengage it from said belt means as said segments are dispensed thereby maintaining a pressure on the rear of said stack adequate to move it forwardly but serving also to disengage the compressor form the belt means to avoid excessive pressure (d) said holder having at its front end an opening permitting removal of individual segments, (e) a segment extractor in the form of a rotating vacuum wheel adjacent such opening and able, while rotating and exerting a vacuum, to extract each foremost segment from the stack onto its periphery and (f) means for continuously rotating the vacuum wheel.

2. The apparatus of claim 1, in which said compressor means is in the form of a plate having a front face facing the rear of said stack and having a lower edge which is hinged to permit tilting of the plate about such lower edge toward and away from said stack, said slip clutch comprising an upper jaw above and a lower jaw below said belt means and means connecting said plate to said lower jaw whereby, as the stack is depleted and the plate tilts forwardly, the lower jaw engages the belt means and together with the upper jaw moves the plate forwardly until the rear of the stack tilts the plate upwardly and disengages the lower jaw from the belt means.

* * * * *